US006162329A

United States Patent [19]

Vinson et al.

[11] Patent Number: 6,162,329

[45] Date of Patent: Dec. 19, 2000

[54] SOFT TISSUE PAPER HAVING A SOFTENING COMPOSITION CONTAINING AN ELECTROLYTE DEPOSITED THEREON

[75] Inventors: Kenneth Douglas Vinson, Cincinnati, Ohio; Sean Patrick Fagin, Erlanger, Ky.; Errol Hoffman Wahl, Cincinnati; Richard Martin Ward, Mason, both of Ohio

[73] Assignee: The Procter & Gamble Company, Cincinnati, Ohio

[21] Appl. No.: 09/053,319

[22] Filed: Apr. 1, 1998

Related U.S. Application Data

[63] Continuation-in-part of application No. 08/942,053, Oct. 1, 1997, abandoned.

[51] Int. Cl.[7] ..... D21H 21/22

[52] U.S. Cl. ..... 162/158; 162/112; 162/135; 162/181.2; 162/181.3; 162/184

[58] Field of Search ..... 162/112, 135, 162/158, 184, 134, 181.1, 181.2, 181.3, 181.4

[56] References Cited

U.S. PATENT DOCUMENTS 5,527,560 6/1996 Fereshtehkhou et al. .
5,611,890 3/1997 Vinson et al. ..... 162/112
5,753,079 5/1998 Jenny et al. .
5,814,188 9/1998 Vinson et al. ..... 162/112

FOREIGN PATENT DOCUMENTS 0 688 901 A2 12/1995 European Pat. Off. .
WO 94/10381 5/1994 WIPO .

*Primary Examiner*—Peter Chin
*Attorney, Agent, or Firm*—Edward J. Milbrada; Donald E. Hasse; Tara M. Rosnell

[57] ABSTRACT

Disclosed is a composition for softening an absorbent tissue and tissue structures softened using the composition. The composition includes an effective amount of a softening active ingredient; a vehicle in which the softening active ingredient is dispersed; and an electrolyte dissolved in the vehicle. The electrolyte causes the viscosity of the composition to be less than the viscosity of a dispersion of the softening active ingredient in the vehicle alone. Preferably, the softening active ingredient is a quaternary ammonium compound with the formula:

$$(R_1)_{4-m}—N^+—[(CH_2)_n—Y—R_3]_mX^-$$

the vehicle is water, and the electrolyte is calcium chloride.

15 Claims, 1 Drawing Sheet

SOFT TISSUE PAPER HAVING A SOFTENING COMPOSITION CONTAINING AN ELECTROLYTE DEPOSITED THEREON

This is a continuation-in-part of application Ser. No. 08/942,053, filed in the name of Vinson, et al. on Oct. 1, 1997, abandoned.

TECHNICAL FIELD

This invention relates, in general, to softening tissue paper; and more specifically, to a composition which may be applied to the surface of tissue paper for enhancing the softness thereof.

BACKGROUND OF THE INVENTION

Sanitary paper tissue products are widely used. Such items are commercially offered in formats tailored for a variety of uses such as facial tissues, toilet tissues and absorbent towels.

All of these sanitary products share a common need, specifically to be soft to the touch. Softness is a complex tactile impression evoked by a product when it is stroked against the skin. The purpose of being soft is so that these products can be used to cleanse the skin without being irritating. Effectively cleansing the skin is a persistent personal hygiene problem for many people. Objectionable discharges of urine, menses, and fecal matter from the perineal area or otorhinolaryngogical mucus discharges do not always occur at a time convenient for one to perform a thorough cleansing, as with soap and copious amounts of water for example. As a substitute for thorough cleansing, a wide variety of tissue and toweling products are offered to aid in the task of removing from the skin and retaining such discharges for disposal in a sanitary fashion. Not surprisingly, the use of these products does not approach the level of cleanliness that can be achieved by the more thorough cleansing methods, and producers of tissue and toweling products are constantly striving to make their products compete more favorably with thorough cleansing methods.

Shortcomings in tissue products for example cause many to stop cleaning before the skin is completely cleansed. Such behavior is prompted by the harshness of the tissue, as continued rubbing with a harsh implement can abrade the sensitive skin and cause severe pain. The alternative, leaving the skin partially cleansed, is chosen even though this often causes malodors to emanate and can cause staining of undergarments, and over time can cause skin irritations as well.

Disorders of the anus, for example hemorrhoids, render the perianal area extremely sensitive and cause those who suffer such disorders to be particularly frustrated by the need to clean their anus without prompting irritation.

Another notable case which prompts frustration is the repeated nose blowing necessary when one has a cold. Repeated cycles of blowing and wiping can culminate in a sore nose even when the softest tissues available today are employed.

Accordingly, making soft tissue and toweling products which promote comfortable cleaning without performance impairing sacrifices has long been the goal of the engineers and scientists who are devoted to research into improving tissue paper. There have been numerous attempts to reduce the abrasive effect, i.e., improve the softness of tissue products.

One area that has been exploited in this regard has been to select and modify cellulose fiber morphologies and engineer paper structures to take optimum advantages of the various available morphologies. Applicable art in this area includes: Vinson et. al. in U.S. Pat. No. 5,228,954, issued Jul. 20, 1993, Vinson in U.S. Pat. No. 5,405,499, issued Apr. 11, 1995, Cochrane et al. in U.S. Pat. No. 4,874,465 issued Oct. 17, 1989, and Hermans, et. al. in U.S. Statutory Invention Registration H1672, published on Aug. 5, 1997, all of which disclose methods for selecting or upgrading fiber sources to tissue and toweling of superior properties. Applicable art is further illustrated by Carstens in U.S. Pat. No. 4,300,981, issued Nov. 17, 1981, which discusses how fibers can be incorporated to be compliant to paper structures so that they have maximum softness potential. While such techniques as illustrated by these prior art examples are recognized broadly, they can only offer some limited potential to make tissues truly effective comfortable cleaning implements.

Another area which has received a considerable amount of attention is the addition of chemical softening agents (also referred to herein as "chemical softeners") to tissue and toweling products.

As used herein, the term "chemical softening agent" refers to any chemical ingredient which improves the tactile sensation perceived by the consumer who holds a particular paper product and rubs it across the skin. Although somewhat desirable for towel products, softness is a particularly important property for facial and toilet tissues. Such tactile perceivable softness can be characterized by, but is not limited to, friction, flexibility, and smoothness, as well as subjective descriptors, such as a feeling like lubricious, velvet, silk or flannel. which imparts a lubricious feel to tissue. This includes, for exemplary purposes only, basic waxes such as paraffin and beeswax and oils such as mineral oil and silicone oil as well as petrolatum and more complex lubricants and emollients such as quaternary ammonium compounds with long alkyl chains, functional silicones, fatty acids, fatty alcohols and fatty esters.

The field of work in the prior art pertaining to chemical softeners has taken two paths. The first path is characterized by the addition of softeners to the tissue paper web during its formation either by adding an attractive ingredient to the vats of pulp which will ultimately be formed into a tissue paper web, to the pulp slurry as it approaches a paper making machine, or to the wet web as it resides on a Fourdrinier cloth or dryer cloth on a paper making machine.

The second path is categorized by the addition of chemical softeners to tissue paper web after the web is dried. Applicable processes can be incorporated into the paper making operation as, for example, by spraying onto the dry web before it is wound into a roll of paper.

Exemplary art related to the former path categorized by adding chemical softeners to the tissue paper prior to its assembly into a web includes U S. Pat. No. 5,264,082, issued to Phan and Trokhan on Nov. 23, 1993, incorporated herein by reference. Such methods have found broad use in the industry especially when it is desired to reduce the strength which would otherwise be present in the paper and when the papermaking process, particularly the creping operation, is robust enough to tolerate incorporation of the bond inhibiting agents. However, there are problems associated with these methods, well known to those skilled in the art. First, the location of the chemical softener is not controlled; it is spread as broadly through the paper structure as the fiber furnish to which it is applied. In addition, there is a loss of paper strength accompanying use of these additives. While not being bound by theory, it is widely believed that the additives tend to inhibit the formation of fiber to fiber hydrogen bonds. There also can be a loss of control of the sheet as it is creped from the Yankee dryer. Again, a widely believed theory is that the additives interfere with the coating on the Yankee dryer so that the bond between the wet web and the dryer is weakened. Prior art such as U.S. Pat. No. 5,487,813, issued to Vinson, et. al., Jan. 30, 1996, incorporated herein by reference, discloses a chemical combination to mitigate the before mentioned effects on strength and adhesion to the creping cylinder; however, there still remains a need to incorporate a chemical softener into a paper web in a targeted fashion with minimal effect on web strength and interference with the production process.

Further exemplary art related to the addition of chemical softeners to the tissue paper web during its formation includes U.S. Pat. No. 5,059,282, issued to Ampulski, et. al. on Oct. 22, 1991 incorporated herein by reference. The Ampulski patent discloses a process for adding a polysiloxane compound to a wet tissue web (preferably at a fiber consistency between about 20% and about 35%). Such a method represents an advance in some respects over the addition of chemicals into the slurry vats supplying the papermaking machine. For example, such means target the application to one of the web surfaces as opposed to distributing the additive onto all of the fibers of the furnish. However, such methods fail to overcome the primary disadvantages of the addition of chemical softeners to the wet end of the papermaking machine, namely the strength effects and the effects on the coating of the Yankee dryer, should such a dryer be employed.

Because of the before mentioned effects on strength and disruption of the papermaking process, considerable art has been devised to apply chemical softeners to already-dried paper webs either at the so-called dry end of the papermaking machine or in a separate converting operation subsequent to the papermaking step. Exemplary art from this field includes U.S. Pat. No. 5,215,626, issued to Ampulski, et. al. on Jun. 1, 1993; U.S. Pat. No. 5,246,545, issued to Ampulski, et. al. on Sep. 21, 1993; and U.S. Pat. No. 5,525,345, issued to Warner, et. al. on Jun. 11, 1996, all incorporated herein by reference. The U.S. Pat. No. 5,215,626 discloses a method for preparing soft tissue paper by applying a polysiloxane to a dry web. The U.S. Pat. No. 5,246,545 discloses a similar method utilizing a heated transfer surface. Finally, the Warner Patent discloses methods of application including roll coating and extrusion for applying particular compositions to the surface of a dry tissue web. While each of these references represent advances over the previous so-called wet end methods particularly with regard to eliminating the degrading effects on the papermaking process, none are able to completely address the loss of tensile strength which accompanies application to the dry paper web.

One of the most important physical properties related to softness is generally considered by those skilled in the art to be the strength of the web. Strength is the ability of the product, and its constituent webs, to maintain physical integrity and to resist tearing, bursting, and shredding under use conditions. Achieving a high softening potential without degrading strength has long been an object of workers in the field of the present invention.

Accordingly, it is an object of the present invention to provide a softening composition suitable for an absorbent tissue product, i.e. one which delivers particularly effective softening without performance impairing sacrifices such as in the strength or absorbency of the paper.

This and other objects are obtained using the present invention as will be taught in the following disclosure.

SUMMARY OF THE INVENTION

The present invention describes softening compositions that, when applied to tissue webs, preferably dried tissue webs, provide soft, strong, absorbent, and aesthetically pleasing tissue paper. The composition is a dispersion comprising:

- an effective amount of a softening active ingredient;
- a vehicle in which the softening active ingredient is dispersed; and
- an electrolyte dissolved in the vehicle, the electrolyte causing the viscosity of the composition to be less than the viscosity of a dispersion of the softening composition in the vehicle alone.

The term "vehicle" as used herein means a fluid that completely dissolves a chemical papermaking additive, or a fluid that is used to emulsify a chemical papermaking additive, or a fluid that is used to suspend a chemical papermaking additive. The vehicle may also serve as a carrier that contains a chemical additive or aids in the delivery of a chemical papermaking additive. All references are meant to be interchangeable and not limiting. The dispersion is the fluid containing the chemical papermaking additive. The term "dispersion" as used herein includes true solutions, suspensions, and emulsions. For purposes for this invention, all terms are interchangeable and not limiting. If the vehicle is water or an aqueous solution, then, preferably, the hot web is dried to a moisture level below its equilibrium moisture content (at standard conditions) before being contacted with the composition. However, this process is also applicable to tissue paper at or near its equilibrium moisture content as well.

The amount of papermaking additive applied to the tissue paper is preferably, between about 0.1% and about 10% based on the total weight of the softening composition compared to the total weight of the resulting tissue paper. The resulting tissue paper preferably has a basis weight of from about 10 to about 80 g/m$^2$ and a fiber density of less than about 0.6 g/cc.

All percentages, ratios and proportions herein are by weight, unless otherwise specified.

Figure 1:
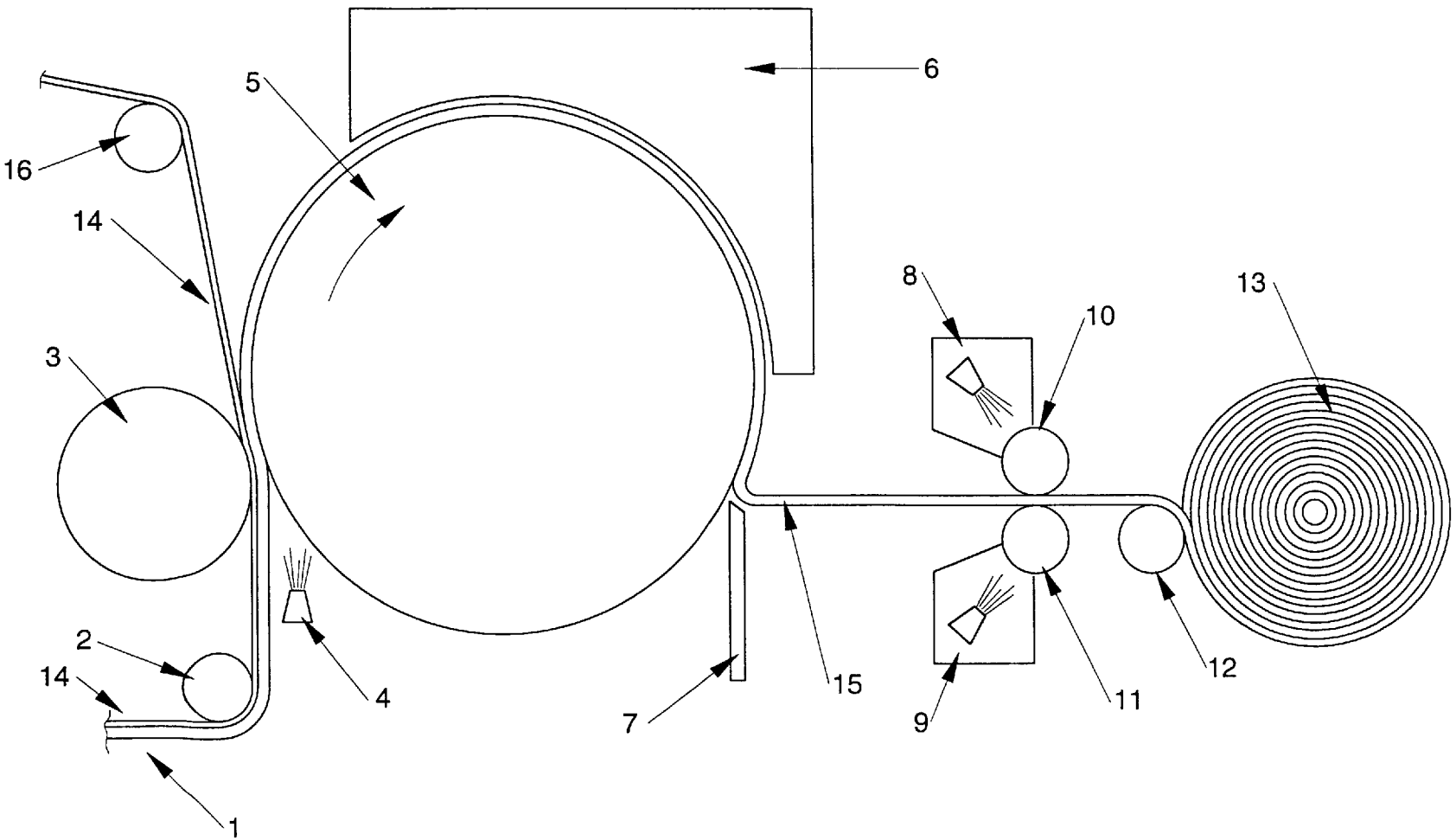
FIG. 1 is a schematic representation illustrating a preferred embodiment of the process of the present invention of adding chemical papermaking additive compounds to a tissue web.

The present invention is described in more detail below.

DETAILED DESCRIPTION OF THE INVENTION

Briefly, the present invention provides a composition which may be applied to a dry tissue web or to a semi-dry tissue web. The resulting tissue paper has enhanced tactile perceivable softness. The term "dry tissue web" as used herein includes both webs which are dried to a moisture content less than the equilibrium moisture content thereof (overdried-see below) and webs which are at a moisture content in equilibrium with atmospheric moisture. A semi-dry tissue paper web includes a tissue web with a moisture content exceeding its equilibrium moisture content. Most preferably the composition herein is applied to a dry tissue paper web.

The softening composition as well as a method for producing the combination and a method of applying it to tissue are also described.

Surprisingly, it has been found that very low levels of softener additives, e.g. cationic softeners, provide a significant tissue softening effect when applied to the surface of tissue webs in accordance with the present invention. Importantly, it has been found that the levels of softener additives used to soften the tissue paper are low enough that the tissue paper retains high wettability. Furthermore, because the softening composition has a high active level when the softening composition is applied, the composition can be applied to dry tissue webs without requiring further drying of the tissue web.

As used herein, the term "hot tissue web" refers to a tissue web which is at an elevated temperature relative to room temperature. Preferably the elevated temperature of the web is at least about 43° C., and more preferably at least about 65° C.

The moisture content of a tissue web is related to the temperature of the web and the relative humidity of the environment in which the web is placed. As used herein, the term "overdried tissue web" refers to a tissue web that is dried to a moisture content less than its equilibrium moisture content at standard test conditions of 23° C. and 50% relative humidity. The equilibrium moisture content of a tissue web placed in standard testing conditions of 23° C. and 50% relative humidity is approximately 7%. A tissue web of the present invention can be overdried by raising it to an elevated temperature through use of drying means known to the art such as a Yankee dryer or through air drying. Preferably, an overdried tissue web will have a moisture content of less than 7%, more preferably from about 0 to about 6%, and most preferably, a moisture content of from about 0 to about 3%, by weight.

Paper exposed to the normal environment typically has an equilibrium moisture content in the range of 5 to 8%. When paper is dried and creped the moisture content in the sheet is generally less than 3%. After manufacturing, the paper absorbs water from the atmosphere. In the preferred process of the present invention, advantage is taken of the low moisture content in the paper as it leaves the doctor blade as it is removed from the Yankee dryer (or the low moisture content of similar webs as such webs are removed from alternate drying means if the process does not involve a Yankee dryer).

In a preferred embodiment, the composition of the present invention is applied to an overdried tissue web shortly after it is separated from a drying means and before it is wound onto a parent roll. Alternatively, the composition of the present invention may be applied to a semi-dry tissue web, for example while the web is on the Fourdrinier cloth, on a drying felt or fabric, or while the web is in contact with the Yankee dryer or other alternative drying means. Finally, the composition can also be applied to a dry tissue web in moisture equilibrium with its environment as the web is unwound from a parent roll as for example during an off-line converting operation.

Tissue Paper

The present invention is applicable to tissue paper in general, including but not limited to conventionally felt-pressed tissue paper; pattern densified tissue paper such as exemplified by Sanford-Sisson and its progeny; and high-bulk, uncompacted tissue paper such as exemplified by Salvucci. The tissue paper may be of a homogenous or multilayered construction; and tissue paper products made therefrom may be of a single-ply or multi-ply construction. The tissue paper preferably has a basis weight of between about 10 g/m$^2$ and about 80 g/m$^2$, and density of about 0.60 g/cc or less. Preferably, the basis weight will be below about 35 g/m$^2$ or less; and the density will be about 0.30 g/cc or less. Most preferably, the density will be between about 0.04 g/cc and about 0.20 g/cc.

Conventionally pressed tissue paper and methods for making such paper are known in the art. Such paper is typically made by depositing a papermaking furnish on a foraminous forming wire. This forming wire is often referred to in the art as a Fourdrinier wire. Once the furnish is deposited on the forming wire, it is referred to as a web. Overall, water is removed from the web by vacuum, mechanical pressing and thermal means. The web is dewatered by pressing the web and by drying at elevated temperature. The particular techniques and typical equipment for making webs according to the process just described are well known to those skilled in the art. In a typical process, a low consistency pulp furnish is provided in a pressurized headbox. The headbox has an opening for delivering a thin deposit of pulp furnish onto the Fourdrinier wire to form a wet web. The web is then typically dewatered to a fiber consistency of between about 7% and about 45% (total web weight basis) by vacuum dewatering and further dried by pressing operations wherein the web is subjected to pressure developed by opposing mechanical members, for example, cylindrical rolls. The dewatered web is then further pressed and dried by a stream drum apparatus known in the art as a Yankee dryer. Pressure can be developed at the Yankee dryer by mechanical means such as an opposing cylindrical drum pressing against the web. Multiple Yankee dryer drums may be employed, whereby additional pressing is optionally incurred between the drums. The tissue paper structures which are formed are referred to hereinafter as conventional, pressed, tissue paper structures. Such sheets are considered to be compacted, since the web is subjected to substantial overall mechanical compression forces while the fibers are moist and are then dried while in a compressed state. The resulting structure is strong and generally of singular density, but very low in bulk, absorbency and in softness.

Pattern densified tissue paper is characterized by having a relatively high-bulk field of relatively low fiber density and an array of densified zones of relatively high fiber density. The high-bulk field is alternatively characterized as a field of pillow regions. The densified zones are alternatively referred to as knuckle regions. The densified zones may be discretely spaced within the high-bulk field or may be interconnected, either fully or partially, within the high-bulk field. Preferred processes for making pattern densified tissue webs are disclosed in U.S. Pat. No. 3,301,746, issued to Sanford and Sisson on Jan. 31, 1967, U.S. Pat. No. 3,974,025, issued to Ayers on Aug. 10, 1976, and U.S. Pat. No. 4,191,609, issued to on Mar. 4, 1980, and U.S. Pat. No. 4,637,859, issued to on Jan. 20, 1987; the disclosure of each of which is incorporated herein by reference.

In general, pattern densified webs are preferably prepared by depositing a papermaking furnish on a foraminous forming wire such as a Fourdrinier wire to form a wet web and then juxtaposing the web against an array of supports as it is transferred from the forming wire to a structure comprising such supports for further drying. The web is pressed against the array of supports, thereby resulting in densified zones in the web at the locations geographically corresponding to the points of contact between the array of supports and the wet web. The remainder of the web not compressed during this operation is referred to as the high-bulk field.

This high-bulk field can be further dedensified by application of fluid pressure, such as with a vacuum type device or a blow-through dryer, or by mechanically pressing the web against the array of supports. The web is dewatered, and optionally predried, in such a manner so as to substantially avoid compression of the high-bulk field. This is preferably accomplished by fluid pressure, such as with a vacuum type device or blow-through dryer, or alternately by mechanically pressing the web against an array of supports wherein the high-bulk field is not compressed. The operations of dewatering, optional predrying and formation of the densified zones may be integrated or partially integrated to reduce the total number of processing steps performed. Subsequent to formation of the densified zones, dewatering, and optional predrying, the web is dried to completion, preferably still avoiding mechanical pressing. Preferably, from about 8% to about 65% of the tissue paper surface comprises densified knuckles, the knuckles preferably having a relative density of at least 125% of the density of the high-bulk field.

The structure comprising an array of supports is preferably an imprinting carrier fabric having a patterned displacement of knuckles which operate as the array of supports which facilitate the formation of the densified zones upon application of pressure. The pattern of knuckles constitutes the array of supports previously referred to. Imprinting carrier fabrics are disclosed in U.S. Pat. No. 3,301,746, issued to Sanford and Sisson on Jan. 31, 1967, U.S. Pat. No. 3,821,068, issued to Salvucci, Jr. et al. on May 21, 1974, U.S. Pat. No. 3,974,025, issued to Ayers on Aug. 10, 1976, U.S. Pat. No. 3,573,164, issued to Friedberg, et al. on Mar. 30, 1971, U.S. Pat. No. 3,473,576, issued to Amneus on Oct. 21, 1969, U.S. Pat. No. 4,239,065, issued to Trokhan on Dec. 16, 1980, and U.S. Pat. No. 4,528,239, issued to Trokhan on Jul. 9, 1985, the disclosure of each of which is incorporated herein by reference.

Preferably, the furnish is first formed into a wet web on a foraminous forming carrier, such as a Fourdrinier wire. The web is dewatered and transferred to an imprinting fabric. The furnish may alternately be initially deposited on a foraminous supporting carrier which also operates as an imprinting fabric. Once formed, the wet web is dewatered and, preferably, thermally predried to a selected fiber consistency of between about 40% and about 80%. Dewatering is preferably performed with suction boxes or other vacuum devices or with blow-through dryers. The knuckle imprint of the imprinting fabric is impressed in the web as discussed above, prior to drying the web to completion. One method for accomplishing this is through application of mechanical pressure. This can be done, for example, by pressing a nip roll which supports the imprinting fabric against the face of a drying drum, such as a Yankee dryer, wherein the web is disposed between the nip roll and drying drum. Also, preferably, the web is molded against the imprinting fabric prior to completion of drying by application of fluid pressure with a vacuum device such as a suction box, or with a blow-through dryer. Fluid pressure may be applied to induce impression of densified zones during initial dewatering, in a separate, subsequent process stage, or a combination thereof.

Uncompacted, non pattern-densified tissue paper structures are described in U.S. Pat. No. 3,812,000 issued to Joseph L. Salvucci, Jr. and Peter N. Yiannos on May 21, 1974, and U.S. Pat. No. 4,208,459, issued to Henry E. Becker, Albert L. McConnell, and Richard Schutte on Jun. 17, 1980, both of which are incorporated herein by reference. In general, uncompacted, non pattern-densified tissue paper structures are prepared by depositing a papermaking furnish on a foraminous forming wire such as a Fourdrinier wire to form a wet web, draining the web and removing additional water without mechanical compression until the web has a fiber consistency of at least 80%, and creping the web. Water is removed from the web by vacuum dewatering and thermal drying. The resulting structure is a soft but weak high-bulk sheet of relatively uncompacted fibers. Bonding material is preferably applied to portions of the web prior to creping.

The softening composition of the present invention can also be applied to uncreped tissue paper. Uncreped tissue paper, a term as used herein, refers to tissue paper which is non-compressively dried, most preferably by through air drying. Resultant through air dried webs are pattern densified such that zones of relatively high density are dispersed within a high bulk field, including pattern densified tissue wherein zones of relatively high density are continuous and the high bulk field is discrete.

To produce uncreped tissue paper webs, an embryonic web is transferred from the foraminous forming carrier upon which it is laid, to a slower moving, high fiber support transfer fabric carrier. The web is then transferred to a drying fabric upon which it is dried to a final dryness. Such webs can offer some advantages in surface smoothness compared to creped paper webs.

The techniques to produce uncreped tissue in this manner are taught in the prior art. For example, Wendt, et. al. in European Patent Application 0 677 612A2, published Oct. 18, 1995 and incorporated herein by reference, teach a method of making soft tissue products without creping. In another case, Hyland, et. al. in European Patent Application 0 617 164 A1, published Sep. 28, 1994 and incorporated herein by reference, teach a method of making smooth uncreped through air dried sheets. Finally, Farrington, et. al. in U.S. Pat. No. 5,656,132 published Aug. 12, 1997, the disclosure of which is incorporated herein by reference, describes the use of a machine to make soft through air dried tissues without the use of a Yankee.

Furnish

Papermaking Fibers

The papermaking fibers utilized for the present invention will normally include fibers derived from wood pulp. Other cellulosic fibrous pulp fibers, such as cotton linters, bagasse, etc., can be utilized and are intended to be within the scope of this invention. Synthetic fibers, such as rayon, polyethylene and polypropylene fibers, may also be utilized in combination with natural cellulosic fibers. One exemplary polyethylene fiber which may be utilized is Pulpex®, available from Hercules, Inc. (Wilmington, Del.).

Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, are preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. Also applicable to the present invention are fibers derived from recycled paper, which may contain any or all of the above categories as well as other non-fibrous materials such as fillers and adhesives used to facilitate the original papermaking.

Optional Chemical Additives

Other materials can be added to the aqueous papermaking furnish or the embryonic web to impart other characteristics to the product or improve the papermaking process so long as they are compatible with the chemistry of the softening composition and do not significantly and adversely affect the softness or strength character of the present invention. The following materials are expressly included, but their inclusion is not offered to be all-inclusive. Other materials can be included as well so long as they do not interfere or counteract the advantages of the present invention.

It is common to add a cationic charge biasing species to the papermaking process to control the zeta potential of the aqueous papermaking furnish as it is delivered to the papermaking process. These materials are used because most of the solids in nature have negative surface charges, including the surfaces of cellulosic fibers and fines and most inorganic fillers. One traditionally used cationic charge biasing species is alum. More recently in the art, charge biasing is done by use of relatively low molecular weight cationic synthetic polymers preferably having a molecular weight of no more than about 500,000 and more preferably no more than about 200,000, or even about 100,000. The charge densities of such low molecular weight cationic synthetic polymers are relatively high. These charge densities range from about 4 to about 8 equivalents of cationic nitrogen per kilogram of polymer. One example material is Cypro 514®, a product of Cytec, Inc. of Stamford, Conn. The use of such materials is expressly allowed within the practice of the present invention.

The use of high surface area, high anionic charge microparticles for the purposes of improving formation, drainage, strength, and retention is taught in the art. See, for example, U.S. Pat. No. 5,221,435, issued to Smith on Jun. 22, 1993, the disclosure of which is incorporated herein by reference. Common materials for this purpose are silica colloid, or bentonite clay. The incorporation of such materials is expressly included within the scope of the present invention.

If permanent wet strength is desired, the group of chemicals: including polyanide-epichlorohydrin, polyacrylamides, styrene-butadiene lattices; insolubilized polyvinyl alcohol; urea-formaldehyde; polyethyleneimine; chitosan polymers and mixtures thereof can be added to the papermaking furnish or to the embryonic web. Preferred resins are cationic wet strength resins, such as polyamide-epichlorohydrin resins. Suitable types of such resins are described in U.S. Pat. No. 3,700,623, issued on Oct. 24, 1972, and U.S. Pat. No. 3,772,076, issued on Nov. 13, 1973, both to Keim, the disclosure of both being hereby incorporated by reference. One commercial source of useful polyanide-epichlorohydrin resins is Hercules, Inc. of Wilmington, Del., which markets such resin under the mark Kymene 557H®.

Many paper products must have limited strength when wet because of the need to dispose of them through toilets into septic or sewer systems. If wet strength is imparted to these products, fugitive wet strength, characterized by a decay of part or all of the initial strength upon standing in presence of water, is preferred. If fugitive wet strength is desired, the binder materials can be chosen from the group consisting of dialdehyde starch or other resins with aldehyde functionality such as Co-Bond 1000® offered by National Starch and Chemical Company of Scarborough, Me.; Parez 750® offered by Cytec of Stamford, Conn.; and the resin described in U.S. Pat. No. 4,981,557, issued on Jan. 1, 1991, to Bjorkquist, the disclosure of which is incorporated herein by reference, and other such resins having the decay properties described above as may be known to the art.

If enhanced absorbency is needed, surfactants may be used to treat the tissue paper webs of the present invention. The level of surfactant, if used, is preferably from about 0.01% to about 2.0% by weight, based on the dry fiber weight of the tissue web. The surfactants preferably have alkyl chains with eight or more carbon atoms. Exemplary anionic surfactants include linear alkyl sulfonates and alkylbenzene sulfonates. Exemplary nonionic surfactants include alkylglycosides including alkylglycoside esters such as Crodesta SL40® which is available from Croda, Inc. (New York, N.Y.); alkylglycoside ethers as described in U.S. Pat. No. 4.011,389, issued to W. K. Langdon, et al. on Mar. 8, 1977; and alkylpolyethoxylated esters such as Pegosperse 200 ML available from Glyco Chemicals, Inc. (Greenwich, Conn.) and IGEPAL RC-520® available from Rhone Poulenc Corporation (Cranbury, N.J.).

While the essence of the present invention is the presence of a softening agent composition deposited on the tissue web surface, the invention also expressly includes variations in which chemical softening agents are added as a part of the papermaking process. For example, chemical softening agents may be included by wet end addition. Preferred chemical softening agents comprise quaternary ammonium compounds including, but not limited to, the well-known dialkyldimethylammonium salts (e.g. ditallowdimethylammonium chloride, ditallowdimethylammonium methyl sulfate, di(hydrogenated tallow)dimethyl ammonium chloride, etc.). Particularly preferred variants of these softening agents are what are considered to be mono or diester variations of the before mentioned dialkyldimethylammonium salts. Another class of papermaking-added chemical softening agents comprise the well-known organo-reactive polydimethyl siloxane ingredients, including the most preferred amino functional polydimethyl siloxane.

Filler materials may also be incorporated into the tissue papers of the present invention. U.S. Pat. No. 5,611,890, issued to Vinson et al. on Mar. 18, 1997, and, incorporated herein by reference discloses filled tissue paper products that are acceptable as substrates for the present invention.

The above listings of optional chemical additives is intended to be merely exemplary in nature, and are not meant to limit the scope of the invention.

Softening Composition

In general, the softening composition of the present invention comprises a dispersion of a softening active ingredient in a vehicle. When applied to tissue paper as described herein, such compositions are effective in softening the tissue paper. Preferably, the softening composition of the present invention has properties (e.g., ingredients, rheology, pH, etc.) permitting easy application thereof on a commercial scale. For example, while certain volatile organic solvents may readily dissolve high concentrations of effective softening materials, such solvents are not desired because of the increased process safety and environmental burden (VOC) concerns raised by such solvents. The following discusses each of the components of the softening composition of the present invention, the properties of the composition, methods of producing the composition, and methods of applying the composition.

Components

Softening Active Ingredients

Quaternary compounds having the formula:

$$(R_1)_{4-m}—N^+—[R_2]_mX^-$$

wherein:

m is 1 to 3;

each $R_1$ is a $C_1$–$C_6$ alkyl group, hydroxyalkyl group, hydrocarbyl or substituted hydrocarbyl group, alkoxylated group, benzyl group, or mixtures thereof;

each $R_2$ is a $C_{14}$–$C_{22}$ alkyl group, hydroxyalkyl group, hydrocarbyl or substituted hydrocarbyl group, alkoxylated group, benzyl group, or mixtures thereof; and $X^-$ is any softener-compatible anion are suitable for use in the present invention. Preferably, each $R_1$ is methyl and $X^-$ is chloride or methyl sulfate. Preferably, each $R_2$ is $C_{16}$–$C_{18}$ alkyl or alkenyl, most preferably each $R_2$ is straight-chain $C_{18}$ alkyl or alkenyl. Optionally, the $R_2$ substituent can be derived from vegetable oil sources. Several types of the vegetable oils (e.g., olive, canola, safflower, sunflower, etc.) can used as sources of fatty acids to synthesize the quaternary ammonium compound.

Such structures include the well-known dialkyldimethylammonium salts (e.g. ditallowdimethylammonium chloride, ditallowdimethylammonium methyl sulfate, di(hydrogenated tallow)dimethyl ammonium chloride, etc.), in which $R_1$ are methyl groups, $R_2$ are tallow groups of varying levels of saturation, and $X^-$ is chloride or methyl sulfate.

As discussed in Swern, Ed. in Bailey's Industrial Oil and Fat Products, Third Edition, John Wiley and Sons (New York 1964), tallow is a naturally occurring material having a variable composition. Table 6.13 in the above-identified reference edited by Swern indicates that typically 78% or more of the fatty acids of tallow contain 16 or 18 carbon atoms. Typically, half of the fatty acids present in tallow are unsaturated, primarily in the form of oleic acid. Synthetic as well as natural "tallows" fall within the scope of the present invention. It is also known that depending upon the product characteristic requirements, the saturation level of the ditallow can be tailored from non hydrogenated (soft) to touch (partially hydrogenated) or completely hydrogenated (hard). All of above-described saturation levels of are expressly meant to be included within the scope of the present invention.

Particularly preferred variants of these softening active ingredients are what are considered to be mono or diester variations of these quaternary ammonium compounds having the formula:

$$(R_1)_{4-m}—N^+—[(CH_2)_n—Y—R_3]_mX^-$$

wherein

Y is —O—(O)C—, or —C(O)—O—, or —NH—C(O)—, or —C(O)—NH—;

m is 1 to 3;

n is 0 to 4;

each $R_1$ is a $C_1$–$C_6$ alkyl group, hydroxyalkyl group, hydrocarbyl or substituted hydrocarbyl group, alkoxylated group, benzyl group, or mixtures thereof;

each $R_3$ is a $C_{13}$–$C_{21}$ alkyl group, hydroxyalkyl group, hydrocarbyl or substituted hydrocarbyl group, alkoxylated group, benzyl group, or mixtures thereof, and $X^-$ is any softener-compatible anion.

Preferably, Y=—O—(O)C—, or —C(O)—O—; m=2; and n=2. Each $R_1$ substituent is preferably a $C_1$–$C_3$, alkyl group, with methyl being most preferred. Preferably, each $R_3$ is $C_{13}$–$C_{17}$ alkyl and/or alkenyl, more preferably $R_3$ is straight chain $C_{15}$–$C_{17}$ alkyl and/or alkenyl, $C_{15}$–$C_{17}$ alkyl, most preferably each $R_3$ is straight-chain $C_{17}$ alkyl. Optionally, the $R_3$ substituent can be derived from vegetable oil sources. Several types of the vegetable oils (e.g., olive, canola, safflower, sunflower, etc.) can used as sources of fatty acids to synthesize the quaternary ammonium compound. Preferably, olive oils, canola oils, high oleic safflower, and/or high erucic rapeseed oils are used to synthesize the quaternary ammonium compound.

As mentioned above, $X^-$ can be any softener-compatible anion, for example, acetate, chloride, bromide, methylsulfate, formate, sulfate, nitrate and the like can also be used in the present invention. Preferably $X^-$ is chloride or methyl sulfate.

Specific examples of ester-functional quaternary ammonium compounds having the structures named above and suitable for use in the present invention include the well-known diester dialkyl dimethyl ammonium salts such as diester ditallow dimethyl ammonium chloride, monoester ditallow dimethyl ammonium chloride, diester ditallow dimethyl ammonium methyl sulfate, diester di(hydrogenated) tallow dimethyl ammonium methyl sulfate, diester di(hydrogenated)tallow dimethyl ammonium chloride, and mixtures thereof Diester ditallow dimethyl ammonium chloride and diester di(hydrogenated)tallow dimethyl ammonium chloride are particularly preferred. These particular materials are available commercially from Witco Chemical Company Inc. of Dublin, Ohio under the tradename "ADOGEN SDMC".

As mentioned above, typically, half of the fatty acids present in tallow are unsaturated, primarily in the form of oleic acid. Synthetic as well as natural "tallows" fall within the scope of the present invention. It is also known that depending upon the product characteristic requirements, the degree of saturation for such tallows can be tailored from non hydrogenated (soft), to partially hydrogenated (touch), or completely hydrogenated (hard). All of above-described saturation levels of are expressly meant to be included within the scope of the present invention.

It will be understood that substituents $R_1$, $R_2$ and $R_3$ may optionally be substituted with various groups such as alkoxyl, hydroxyl, or can be branched. As mentioned above, preferably each $R_1$ is methyl or hydroxyethyl. Preferably, each $R_2$ is $C_{12}$–$C_{18}$ alkyl and/or alkenyl, most preferably each $R_2$ is straight-chain $C_{16}$–$C_{18}$ alkyl and/or alkenyl, most preferably each $R_2$ is straight-chain $C_{18}$ alkyl or alkenyl. Preferably $R_3$ is $C_{13}$–$C_{17}$ alkyl and/or alkenyl, most preferably $R_3$ is straight chain $C_{15}$–$C_{17}$ alkyl and/or alkenyl. Preferably, $X^-$ is chloride or methyl sulfate. Furthermore the ester-functional quaternary ammonium compounds can optionally contain up to about 10% of the mono(long chain alkyl) derivatives, e.g.:

$$(R_1)_2—N^+—((CH_2)_2OH)((CH_2)_2OC(O)R_3)X^-$$

as minor ingredients. These minor ingredients can act as emulsifiers and are useful in the present invention.

Other types of suitable quaternary ammonium compounds for use in the present invention are described in U.S. Pat. No. 5,543,067, issued to Phan et al. on Aug. 6, 1996; U.S. Pat. No. 5,538,595, issued to Trokhan et al., on Jul. 23, 1996; U.S. Pat. No. 5,510,000, issued to Phan et al. on Apr. 23, 1996; U.S. Pat. No. 5415,737, issued to Phan et al., on May 16, 1995; and European Patent Application No. 0 688 901 A2, assigned to Kimberly-Clark Corporation, published Dec. 12, 1995; the disclosure of each of which is incorporated herein by reference.

Di-quat variations of the ester-functional quaternary ammonium compounds can also be used, and are meant to fall within the scope of the present invention. These compounds have the formula:

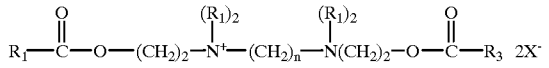

In the structure named above each $R_1$ is a $C_1$–$C_6$alkyl or hydroxyalkyl group, $R_3$ is $C_{11}$–$C_{21}$ hydrocarbyl group, n is 2 to 4 and $X^-$ is a suitable anion, such as an halide (e.g., chloride or bromide) or methyl sulfate. Preferably, each $R_3$ is $C_{13}$–$C_{17}$ alkyl and/or alkenyl, most preferably each $R_3$ is straight-chain $C_{15}$–$C_{17}$ alkyl and/or alkenyl, and $R_1$ is a methyl.

Parenthetically, while not wishing to be bound by theory, it is believed that the ester moiety(ies) of the aforementioned quaternary compounds provides a measure of biodegradability to such compounds. Importantly, the ester-functional quaternary ammonium compounds used herein biodegrade more rapidly than do conventional dialkyl dimethyl ammonium chemical softeners.

The use of quaternary ammonium ingredients as described herein above is most effectively accomplished if the quaternary ammonium ingredient is accompanied by an appropriate plasticizer. The term plasticizer as used herein refers to an ingredient capable of reducing the melting point and viscosity at a given temperature of a quaternary ammonium ingredient. The plasticizer can be added during the quaternizing step in the manufacture of the quaternary ammonium ingredient or it can be added subsequent to the quaternization but prior to the application as a softening active ingredient. The plasticizer is characterized by being substantially inert during the chemical synthesis, but acts as a viscosity reducer to aid in the synthesis. Preferred plasticizers are non-volatile polyhydroxy compounds. Preferred polyhydroxy compounds include glycerol and polyethylene glycols having a molecular weight of from about 200 to about 2000, with polyethylene glycol having a molecular weight of from about 200 to about 600 being particularly preferred. When such plasticizers are added during manufacture of the quaternary ammonium ingredient, they comprise between about 25% and about 75% percent of the product of such manufacture. A particularly preferred mixture comprises about 60% quaternary ammonium ingredient and about 40% plasticizer.

Vehicle

As used herein a "vehicle" is used to dilute the active ingredients of the compositions described herein forming the dispersion of the present invention. A vehicle may dissolve such components (true solution or micellar solution) or such components may be dispersed throughout the vehicle (dispersion or emulsion). The vehicle of a suspension or emulsion is typically the continuous phase thereof. That is, other components of the dispersion or emulsion are dispersed on a molecular level or as discrete particles throughout the vehicle.

For purposes of the present invention, one purpose that the vehicle serves is to dilute the concentration of softening active ingredients so that such ingredients may be efficiently and economically applied to a tissue web. For example, as is discussed below, one way of applying such active ingredients is to spray them onto a roll which then transfers the active ingredients to a moving web of tissue. Typically, only very low levels (e.g. on the order of 2% by weight of the associated tissue) of softening active ingredients are required to effectively improve the tactile sense of softness of a tissue. This means very accurate metering and spraying systems would be required to distribute a "pure" softening active ingredient across the full width of a commercial-scale tissue web.

Another purpose of the vehicle is to deliver the active softening composition in a form in which it is less prone to be mobile with regard to the tissue structure. Specifically, it is desired to apply the composition of the present invention so that the active ingredient of the composition resides primarily on the surface of the absorbent tissue web with minimal absorption into the interior of the web. While not wishing to be bound by theory, the Applicants believe that the interaction of the softening composition with preferred vehicles creates a suspended particle which binds more quickly and permanently than if the active ingredient were to be applied without the vehicle. For example, it is believed that suspensions of quaternary softeners in water assume a micellar form which can be substantively deposited onto the surface of the fibers of the surface of the tissue paper web. Quaternary softeners applied without the aid of the vehicle, i.e. applied in molten form by contrast tend to wick into the internal of the tissue web.

The Applicants have discovered vehicles and softening compositions comprising such vehicles that are particularly useful for facilitating the application of softening active ingredients to webs of tissue on a commercial scale.

In the simplest execution of the present invention, softening ingredients can be dissolved in a vehicle forming a solution therein. However, as noted above, materials that are useful as solvents for suitable softening active ingredients are not commercially desirable for safety and environmental reasons. Therefore, to be suitable for use in the vehicle for purposes of the present invention, a material should be compatible with the softening active ingredients described herein and with the tissue substrate on which the softening compositions of the present invention will be deposited. Further a suitable material should not contain any ingredients that create safety issues (either in the tissue manufacturing process or to users of tissue products using the softening compositions described herein) and not create an unacceptable risk to the environment. Suitable materials for the vehicle of the present invention include hydroxyl functional liquids most preferably water.

Electrolyte

While water is a particularly preferred material for use in the vehicle of the present invention, water alone is not preferred as a vehicle. Specifically, when softening active ingredients of the present invention are dispersed in water at a level suitable for application to a tissue web, the dispersion has an unacceptably high viscosity. While not being bound by theory, the Applicants believe that combining water and the softening active ingredients of the present invention to form such dispersions creates a liquid crystalline phase having a high viscosity. Compositions having such a high viscosity are difficult to apply to tissue webs for softening purposes.

The Applicants have discovered that the viscosity of dispersions of softening active ingredients in water can be substantially reduced, while maintaining a desirable high level of the softening active ingredient in the softening composition by the simple addition of a suitable electrolyte to the vehicle. Again, not being bound by theory, the Applicants believe that such addition affects the size of the charged double layer around any cationically charged species or particles in the dispersion causing a change in the phase structure of the ternary softening active ingredient/water/electrolyte system with a resulting reduction in viscosity of the system.

Any electrolyte meeting the general criteria described above for materials suitable for use in the vehicle of the present invention and which is effective in reducing the viscosity of a dispersion of a softening active ingredient in water is suitable for use in the vehicle of the present invention. In particular, any of the known water-soluble electrolytes meeting the above criteria can be included in the vehicle of the softening composition of the present invention. When present, the electrolyte can be used in amounts up to about 25% by weight of the softening composition, but preferably no more than about 15% by weight of the softening composition. Preferably, the level of electrolyte is between about 0.1% and about 10% by weight of the softening composition based on the anhydrous weight of the electrolyte. Still more preferably, the electrolyte is used at a level of between about 0.3% and about 1.0% by weight of the softening composition. The minimum amount of the electrolyte will be that amount sufficient to provide the desired viscosity. The dispersions typically display a non-Newtonian rheology, and are shear thinning with a desired viscosity generally ranging from about 10 centipoise (cp) up to about 1000 cp, preferably in the range between about 10 and about 200 cp, as measured at 25° C. and at a shear rate of 100 $sec^{-1}$ using the method described in the TEST Methods section below. Suitable electrolytes include the halide, nitrate, nitrite, and sulfate salts of alkali or alkaline earth metals, as well as the corresponding ammonium salts. Other useful electrolytes include the alkali and alkaline earth salts of simple organic acids such as sodium formate and sodium acetate, as well as the corresponding ammonium salts. Preferred electrolytes include the chloride salts of sodium, calcium, and magnesium. Calcium chloride is a particularly preferred electrolyte for the softening composition of the present invention. While not being bound by theory, the humectant properties of calcium chloride and the permanent change in equilibrium moisture content which it imparts to the absorbent tissue product to which the composition is applied make calcium chloride particularly preferred. That is, the Applicants believe that the humectant properties of calcium chloride cause it to be a moisture reservoir that can supply moisture to the cellulosic structure of the tissue. As is known in the art, moisture serves as a plasticizer for cellulose. Therefore, the moisture supplied by the hydrated calcium chloride enables the cellulose to be desirably soft over a wider range of environmental relative humidities than similar structures where there is no calcium chloride present. If desired, compatible blends of the various electrolytes are also suitable.

The vehicle can also comprise minor ingredients as may be known to the art. examples include: mineral acids or buffer systems for pH adjustment (may be required to maintain hydrolytic stability for certain softening active ingredients) and antifoam ingredients (e.g., a silicone emulsion as is available from Dow Corning, Corp. of Midland, Mich. as Dow Corning 2310) as a processing aid to reduce foaming when the softening composition of the present invention is applied to a web of tissue.

Stabilizers may also be used to improve the uniformity and shelf life of the dispersion. For example, an ethoxylated polyester, HOE S 4060, available from Clariant Corporation of Charlotte, N.C. may be included for this purpose.

Process aids may also be used, including for example, a brightener, such as Tinopal CBS-X, obtainable from CIBA-GEIGY of Greensboro, N.C. may be added to the dispersion to allow easy qualitative viewing of the application uniformity, via inspection of the finished tissue web, containing a surface-applied softening composition, under UV light.

Forming the Softening Composition

As noted above, the softening composition of the present invention is a dispersion of a softening active ingredient in a vehicle. Depending on the softening active ingredient chosen, the desired application level and other factors as may require a particular level of softening active ingredient in the composition, the level of softening active ingredient may vary between about 10% of the composition and about 35% of the composition. Preferably, the softening active ingredient comprises between about 20% and about 30% of the composition. Most preferably, the softening active ingredient comprises about 25% of the composition. Depending on the method used to produce the softening active ingredient the softening composition may also comprise between about 2% and about 20%, preferably about 10% of a plasticizer. As noted above, the preferred primary component of the vehicle is water. In addition, the vehicle preferably comprises an alkali or alkaline earth halide electrolyte and may comprise minor ingredients to adjust pH, to control foam, or to aid in stability of the dispersion. The following describes particularly a preferred softening composition of the present invention.

A particularly preferred softening composition of the present invention (Composition 1) is prepared as follows. The materials are more specifically defined in the table detailing Composition 1 which follows this description. Amounts used in each step are sufficient to result in the finished composition detailed in that table. The hydrochloric acid (25% solution), antifoam ingredient and brightener are added to the appropriate quantity of water. This mixture is then heated to about 165° F. (75° C.). Concurrently with heating the water mixture, the blend of softening active ingredient and plasticizer is melted by heating it to a temperature of about 150° F. (65° C.). The melted mixture of softening active ingredient and plasticizer is then slowly added to the heated acidic aqueous phase with mixing to evenly distribute the disperse phase throughout the vehicle. (The water solubility of the polyethylene glycol probably carries it into the continuous phase, but this is not essential to the invention and plasticizers which are more hydrophobic and thus remain associated with the alkyl chains of the quaternary ammonium compound are also allowed within the scope of the present invention.) Once the softening active ingredient is thoroughly dispersed, part of the calcium chloride is added (as a 2.5% solution) intermittently with mixing. The fluid mixture is then homogenized. Any of the methods of homogenizing dispersions can be used for this purpose. An acceptable method of homogenizing a 40 gallon quantity of the softening composition it to use a Ultra-Turrax, model T45 S4 homogenizer, available from Tekmar Company of Cincinnati, Ohio, immersed in the material for a period of 4 hours. The composition is then allowed to cool to room temperature and the stabilizer is slowly added with mixing. Lastly, the remainder of the calcium chloride is added (as a 25% solution) with continued mixing.

Composition 1

| Component | Concentration |
|---|---|
| Continuous Phase | |
| Water | QS to 100% |
| Calcium Chloride[1] | 0.53% |
| Antifoam[2] | 0.15% |
| Hydrochloric Acid[3] | 13 ppm |
| Plasticizer[5] | 12.1% |
| Brightener[6] | 89 ppm |
| Stabilizer[4] | 0.49% |

-continued

| Composition 1 | |
|---|---|
| Component | Concentration |
| Disperse Phase | |
| Softening Active Ingredient[5] | 23.7% |

[1]0.34% from 2.5% aqueous calcium chloride solution and 0.19% from 25% aqueous calcium chloride solution
[2]Silicone Emulsion---Dow Corning 2310 ®, marketed by Dow Corning Corp., Midland, MI
[3]Available from J. T. Baker Chemical Company of Phillipsburg, NJ
[4]Stabilizer is HOE S 4060, from Clariant Corp., Charlotte, NC
[5]Plasticizer and softening active ingredient obtained pre-blended from Witco Chemical Company of Dublin OH, as DP-SC-505-91, which is about 2 parts tallow diester quaternary and 1 part polyethylene glycol 400.
[6]Brightener is Tinopal CBS-X, obtainable from CIBA-GEIGY of Greensboro, NC.

The resulting chemical softening composition is a milky, low viscosity dispersion suitable for application to tissue webs as described below for providing desirable tactile softness to tissue paper produced from such webs. It displays a shear-thinning non-Newtonian viscosity. Suitably, the composition has a viscosity less than about 1000 centipoise (cp), as measured at 25° C. and at a shear rate of 100 $sec^{-1}$ using the method described in the TEST METHODS section below. Preferably, the composition has a viscosity less than about 500 cp. More preferably, the viscosity is less than about 100 cp.

An alternate method of forming a softening composition according to the present invention is to prepare an aqueous phase by first adding the electrolyte (calcium chloride) to an appropriate quantity of water with sufficient mixing to completely dissolve the calcium chloride. The pH of the electrolyte solution is then adjusted to ~4. The pH adjusted water is then heated to about 150° F. (65° C.). Concurrently with heating the water, the quaternary compound and plasticizer is melted at about 150° F. (65° C.). The melted mixture of quaternary compound and plasticizer is then added to the heated acidic salt solution with mixing to evenly distribute the quaternary phase throughout the vehicle. (The water solubility of the polyethylene glycol probably carries it into the continuous phase, but this is not essential to the invention and plasticizers which are more hydrophobic and thus remain associated with the alkyl chains of the quaternary ammonium compound are also allowed within the scope of the present invention.) The composition is then allowed to cool to room temperature and the antifoam agent is added. Any water required to bring the softening composition to 100% is also added at this time.

| Composition 2 | |
|---|---|
| Component | Concentration |
| Vehicle | |
| Water | QS to 100% |
| Calcium Chloride | 4.7% |
| Antifoam[1] | 1.7% |
| Sulfuric Acid | QS to pH 4 |
| Plasticizer[2] | 9.9% |

-continued

| Composition 2 | |
|---|---|
| Component | Concentration |
| Disperse Phase | |
| Softening Active Ingredient | 23.9% |

[1]Polydimethylsiloxane - SF 96-350 ®, a 350 centistoke fluid marketed by General Electric Company of Waterford, NY
[2]Plasticizer and softening active ingredient obtained pre-blended from Witco Chemical Company of Dublin OH, as DP-SC-505-91, which is about 2 parts tallow diester quaternary and 1 part polyethylene glycol 400.

The resulting chemical softening composition is a creamy, slightly viscous dispersion suitable for application to tissue webs as described below for providing desirable tactile softness to tissue paper produced from such webs. It displays a shear-thinning non-Newtonian viscosity. Preferably, the composition has a viscosity between about 100 centipoise (cp) and about 1000 cp, as measured at 25° C. and at a shear rate of 100 $sec^{-1}$ using the method described in the TEST METHODS section below.

Application Method

In one preferred embodiment, the softening composition of the current invention may be applied after the tissue web has been dried and creped, and, more preferably, while the web is still at an elevated temperature. Preferably, the softening composition is applied to the dried and creped tissue web before the web is wound onto the parent roll. Thus, in a preferred embodiment of the present invention the softening composition is applied to a hot, overdried tissue web after the web has been creped as the web passes through the calender rolls which control the caliper.

The softening composition described above is preferably applied to a hot transfer surface which then applies the composition to the tissue paper web. The softening composition should be applied to the heated transfer surface in a macroscopically uniform fashion for subsequent transfer to the tissue paper web so that substantially the entire sheet benefits from the effect of the softening composition. Following application to the heated transfer surface, at least a portion of the volatile components of the vehicle preferably evaporates leaving preferably a thin film containing any remaining unevaporated portion of the volatile components of the vehicle, the softening active ingredient, and other nonvolatile components of the softening composition. By "thin film" is meant any thin coating, haze or mist on the transfer surface. This thin film can be microscopically continuous or be comprised of discrete elements. If the thin film is comprised of discrete elements, the elements can be of uniform size or varying in size; further they may be arranged in a regular pattern or in an irregular pattern, but macroscopically the thin film is uniform. Preferably the thin film is composed of discrete elements.

The softening composition can be added to either side of the tissue web singularly, or to both sides.

Methods of macroscopically uniformly applying the softening composition to the hot transfer surface include spraying and printing. Spraying has been found to be economical, and can be accurately controlled with respect to quantity and distribution of the softening composition, so it is more preferred. Preferably, the dispersed softening composition is applied from the transfer surface onto the dried, creped tissue web after the Yankee dryer and before the parent roll. A particularly convenient means of accomplishing this application is to apply the softener composition to one or both of a pair of heated calender rolls which, in addition to serving as hot transfer surfaces for the present softening composition, also serve to reduce and control the thickness of the dried tissue web to the desired caliper of the finished product.

FIG. 1 illustrates a preferred method of applying the softening composition to the tissue web. Referring to FIG. 1, a wet tissue web 1 is on carrier fabric 14 past turning roll 2 and transferred to Yankee dryer 5 by the action of pressure roll 3 while carrier fabric 14 travels past turning roll 16. The web is adhesively secured to the cylindrical surface of Yankee dryer 5 by adhesive applied by spray applicator 4. Drying is completed by steam-heated Yankee dryer 5 and by hot air which is heated and circulated through drying hood 6 by means not shown. The web is then dry creped from the Yankee dryer 5 by doctor blade 7, after which it is designated creped paper sheet 15. The softening composition of the present invention is sprayed onto an upper heated transfer surface designated as upper calender roll 10 and/or a lower heated transfer surface designated as lower calender roll 11, by spray applicators 8 and 9 depending on whether the softening composition is to be applied to both sides of the tissue web or just to one side. The paper sheet 15 then contacts heated transfer surfaces 10 and 11 after a portion of the vehicle has evaporated. The treated web then travels over a circumferential portion of reel 12, and then is wound onto parent roll 13.

Exemplary materials suitable for the heated transfer surfaces 10, 11 include metal (e.g., steel, stainless steel, and chrome), non-metal (e.g., suitable polymers, ceramic, glass), and rubber. Equipment suitable for spraying softening composition of the present invention onto hot transfer surfaces include external mix, air atomizing nozzles, such as SU14 air atomizing nozzles (Air cap #73328 and Fluid cap #2850) of Spraying Systems Co. of Wheaton, Ill. Equipment suitable for printing softening composition-containing liquids onto hot transfer surfaces include rotogravure or flexographic printers.

The temperature of the heated transfer surface is preferably below the boiling point of the softening composition. Thus, if the predominate component of the vehicle is water, the temperature of the heated transfer surface should be below 100° C. Preferably the temperature is between 50 and 90° C., more preferably between 70° and 90° C. when water is used as the predominate component of the vehicle.

While not wishing to be bound by theory or to otherwise limit the present invention, the following description of typical process conditions encountered during the papermaking operation and their impact on the process described in this invention is provided. The Yankee dryer raises the temperature of the tissue sheet and removes the moisture. The steam pressure in the Yankee is on the order of 110 PSI (750 kPa). This pressure is sufficient to increase the temperature of the cylinder to about 170° C. The temperature of the paper on the cylinder is raised as the water in the sheet is removed. The temperature of the sheet as it leaves the doctor blade can be in excess of 120° C. The sheet travels through space to the calender and the reel and loses some of this heat. The temperature of the paper wound in the reel is measured to be on the order of 60° C. Eventually the sheet of paper cools to room temperature. This can take anywhere from hours to days depending on the size of the paper roll. As the paper cools it also absorbs moisture from the atmosphere.

Since the softening composition of the present invention is applied to the paper while it is overdried, the water added to the paper with the softening composition by this method is not sufficient to cause the paper to lose a significant amount of its strength and thickness. Thus, no further drying is required.

Alternatively, effective amounts of softening active ingredients from the softening compositions of the present invention may also applied to a tissue web that has cooled after initial drying and has come into moisture equilibrium with its environment. The method of applying the softening compositions of the present invention is substantially the same as that described above for application of such compositions to a hot, overdried tissue web. That is, the softening composition may be applied to a transfer surface which then applies the composition to the tissue web. It is not necessary for such transfer surfaces to be heated because the desirable Theological properties of the composition of the present invention allow even application across the full width of a tissue web. Again, the softening composition is preferably applied to a transfer surface in a macroscopically uniform fashion for subsequent transfer to the tissue paper web so that substantially the entire sheet benefits from the effect of the softening composition. Suitable transfer surfaces include patterned printing rolls, engraved transfer rolls (Anilox rolls), and smooth rolls that may be part of an apparatus specifically designed to apply the softening composition or part of an apparatus designed for other functions with respect to the tissue web. An example of means suitable for applying the softening composition of the present invention to an environmentally equilibrated tissue web is the gravure cylinders and printing method described in application Ser. No. 08/777,829, filed in the names of Vinson, et al. on Dec. 31, 1996, the disclosure of which is incorporated herein by reference. Also, as noted above, the softening composition of the present invention could be applied to (e.g. by spraying thereon) a smooth roll (e.g. one of a nip pair) of an apparatus designed for other functions (e.g. converting the tissue web into a finished absorbent tissue product).

While not being bound by theory, the Applicants believe that the softening compositions of the present invention are particularly suitable for application to environmentally equilibrated tissue webs because:

1. Such softening compositions comprise high levels of softening active ingredients and other nonvolatile components. As a result, the amount of water carried to the tissue web by such softening composition is low. For example, when the preferred composition described in Table I is applied to a tissue web at a level providing 0.5% softener active, about 1.25% water is also applied to the web. The Applicants have found that such webs are still acceptably strong and dimensionally stable.

and

2. The hygroscopic properties of the preferred electrolyte, calcium chloride, bind at least a portion of the water in the composition so it is not available for unacceptably lowering the tensile properties of the treated web.

When webs treated as described above have been evaluated for softness according to the method described in the TEST METHODS section below, they have been found to have a softness improvement of at least about 0.2 Panel Score Units (PSU). Preferably, the softness improvement is at least about 0.3 PSU. More preferably, the improvement is at least about 0.5 PSU.

EXAMPLES

Example 1

This Example illustrates preparation of tissue paper exhibiting one embodiment of the present invention. This example demonstrates the production of homogeneous tissue paper webs that are provided with an alternative embodiment of the softening composition of the present invention made using the alternative method described above. The composition is applied to one side of the web and the webs are combined into a two-ply bath tissue product.

A pilot scale Fourdrinier papermaking machine is used in the practice of the present invention.

An aqueous slurry of NSK of about 3% consistency is made up using a conventional repulper and is passed through a stock pipe toward the headbox of the Fourdrinier.

In order to impart a temporary wet strength to the finished product, a 1% dispersion of Parez $_{750}$® is prepared and is added to the NSK stock pipe at a rate sufficient to deliver 0.5% Parez 750® based on the dry weight of the NSK fibers. The absorption of the temporary wet strength resin is enhanced by passing the treated slurry through an in-line mixer.

An aqueous slurry of eucalyptus fibers of about 3% by weight is made up using a conventional repulper. The stock pipe carrying eucalyptus fibers is treated with a cationic starch, RediBOND 5320®, which is delivered as a 2% dispersion in water and at a rate of 0.2% based on the dry weight of starch and the finished dry weight of the resultant creped tissue product. Absorption of the cationic starch is improved by passing the resultant mixture through an in line mixer.

The stream of NSK fibers and eucalyptus fibers are then combined in a single stock pipe prior to the inlet of the fan pump. The combined NSK fibers and eucalyptus fibers are then diluted with white water at the inlet of a fan pump to a consistency of about 0.2% based on the total weight of the NSK fibers and eucalyptus fibers.

The homogeneous slurry of NSK fibers and eucalyptus fibers are directed into a multi-channeled headbox suitably equipped to maintain the homogeneous stream until discharged onto a traveling Fourdrinier wire. The homogeneous slurry is discharged onto the traveling Fourdrinier wire and is dewatered through the Fourdrinier wire and is assisted by a deflector and vacuum boxes.

The embryonic wet web is transferred from the Fourdrinier wire, at a fiber consistency of about 15% at the point of transfer, to a patterned drying fabric. The drying fabric is designed to yield a pattern densified tissue with discontinuous low-density deflected areas arranged within a continuous network of high density (knuckle) areas. This drying fabric is formed by casting an impervious resin surface onto a fiber mesh supporting fabric. The supporting fabric is a 45×52 filament, dual layer mesh. The thickness of the resin cast is about 10 mil above the supporting fabric. The knuckle area is about 40% and the open cells remain at a frequency of about 562 per square inch.

Further de-watering is accomplished by vacuum assisted drainage until the web has a fiber consistency of about 28%.

While remaining in contact with the patterned forming fabric, the patterned web is pre-dried by air blow-through predryers to a fiber consistency of about 62% by weight.

The semi-dry web is then transferred to the Yankee dryer and adhered to the surface of the Yankee dryer with a sprayed creping adhesive comprising a 0. 125% aqueous solution of polyvinyl alcohol. The creping adhesive is delivered to the Yankee surface at a rate of 0.1% adhesive solids based on the dry weight of the web.

The fiber consistency is increased to about 96% before the web is dry creped from the Yankee with a doctor blade.

The doctor blade has a bevel angle of about 25 degrees and is positioned with respect to the Yankee dryer to provide an impact angle of about 81 degrees. The Yankee dryer is operated at a temperature of about 350° F. (177° C.) and a speed of about 800 fpm (feet per minute) (about 244 meters per minute).

The web is then passed between two calender rolls. The bottom calender (transfer) roll is sprayed with a chemical softener composition, further described below, using SU14 air atomizing nozzles (Air cap #73328 and Fluid cap #2850) of Spraying Systems Co. of Wheaton, Ill. The two combiner rolls are biased together at roll weight and operated at surface speeds of 656 fpm (about 200 meters per minute) which produces a percent crepe of about 18%.

Agents used in the preparation of the chemical softener mixture are:

1. Partially hydrogenated tallow diester chloride quaternary ammonium compound premixed with polyethylene glycol 400. The premix is 74% quaternary ammonium compound (Adogen SDMC-type from Witco incorporated and 26% PEG 400, available from J.T. Baker Company of Phillipsburg, N.J.).
2. Calcium Chloride Pellets from J. T. Baker Company of Phillipsburg, N.J.
3. Dimethylpolysiloxane (SF96-350) from General Electric Company Waterford, N.Y.
4. Sulfuric acid from J. T. Baker Company of Phillipsburg, N.J.

The chemical softener mixture is prepared by dissolving calcium chloride in the required quantity of water. The salt solution is then adjusted to pH of about 4 using sulfuric acid. The resultant mixture is heated to about 75° C. The premix of quaternary compound and PEG 400 is then added as a paste and stirred until the mixture is fully homogeneous. The polydimethylsiloxane is added to control foaming. After cooling and addition of make-up water, the components are used in a proportion sufficient to provide a composition having the following approximate concentrations:

25% Partially hydrogenated tallow diester chloride quaternary ammonium compound

9% PEG 400

5% $CaCl_2$

59% Water 1.7% Polydimethylsiloxane

The chemical softener mixture is transferred from the bottom calender roll to one side of the tissue web by direct pressure. The resulting tissue paper has a basis weight of about 12.8 lb per 3000 $ft^2$.

The web is converted into a homogeneous, double-ply creped patterned densified tissue paper product. The resulting tissue paper has an improved tactile sense of softness relative to the untreated control.

Example 2

This example illustrates another method that can be used to make soft tissue paper treated with a softening additive according to the present invention. This example demonstrates the production of a layered tissue paper web with the softening composition of the present invention (also prepared by the alternate method as described hereinbefore) applied to both sides of the web; wherein the web is suitable for a single-ply bath tissue product.

A pilot scale Fourdrinier papermaking machine is used in the practice of the present invention.

An aqueous slurry of Northern Softwood Kraft (NSK) of about 3% consistency is made up using a conventional repulper and is passed through a stock pipe toward the headbox of the Fourdrinier.

In order to impart a temporary wet strength to the finished product, a 1% dispersion of Parez 750® is prepared and is added to the NSK stock pipe at a rate sufficient to deliver 1.0% Parez 750® based on the dry weight of the NSK fibers. The absorption of the temporary wet strength resin is enhanced by passing the treated slurry through an in-line mixer.

An aqueous slurry of Eucalyptus Hardwood Kraft fibers of about 3% consistency is made up using a conventional repulper and is passed through a stock pipe toward the headbox of the Fourdrinier.

In order to impart a temporary wet strength to the finished product and to reduce the dustiness or Tinting of the surface of the tissue paper, a 1% dispersion of Parez 750® is prepared and is added to the eucalyptus stock pipe at a rate sufficient to deliver 0.375% Parez 750® based on the dry weight of the eucalyptus fibers. The absorption of the temporary wet strength resin is enhanced by passing the treated slurry through an in-line mixer.

The NSK fibers are diluted with white water at the inlet of a fan pump to a consistency of about 0.15% based on the total weight of the NSK fiber slurry. The eucalyptus fibers, likewise, are diluted with white water at the inlet of a fan pump to a consistency of about 0.15% based on the total weight of the eucalyptus fiber slurry. The eucalyptus slurry and the NSK slurry are both directed to a layered headbox capable of maintaining the slurries as separate streams until they are deposited onto a forming fabric on the Fourdrinier.

The paper machine has a layered headbox having a top chamber, a center chamber, and a bottom chamber. The eucalyptus fiber slurry is pumped through the top and bottom headbox chambers and, simultaneously, the NSK fiber slurry is pumped through the center headbox chamber and delivered in superposed relation onto the Fourdrinier wire to form thereon a three-layer embryonic web, of which about 80% is made up of the eucalyptus fibers and 20% is made up of the NSK fibers. Dewatering occurs through the Fourdrinier wire and is assisted by a deflector and vacuum boxes. The Fourdrinier wire is of a 5-shed, satin weave configuration having 87 machine-direction and 76 cross-machine-direction direction monofilaments per inch, respectively. The embryonic web is transferred from the Fourdrinier wire, at a fiber consistency of about 22% at the point of transfer, to a patterned drying fabric.

The drying fabric is designed to yield a pattern-densified tissue with discontinuous low-density deflected areas arranged within a continuous network of high density (knuckle) areas. This drying fabric is formed by casting an impervious resin surface onto a fiber mesh supporting fabric. The supporting fabric is a 48×52 filament, dual layer mesh. The thickness of the resin cast above the surface of the secondary is about 15.5 mil. The knuckle area is about 39% and the open cells remain at a frequency of about 78 per square inch.

The web is carried on the drying fabric past the vacuum dewatering box, through the blow-through predryers after which the web is transferred onto a Yankee dryer. The fiber consistency is about 27% after the vacuum dewatering box and, by the action of the redryers, about 65% prior to transfer onto the Yankee dryer; creping adhesive comprising a 0.25% aqueous solution of polyvinyl alcohol is spray-applied to the Yankee dryer surface by applicators; the fiber consistency is increased to an estimated 98% before dry creping the web with a doctor blade. The doctor blade has a bevel angle of 25 degrees and is positioned with respect to the Yankee dryer to provide an impact angle of about 81 degrees; the Yankee dryer is operated at about 315° F. (157° C.); the Yankee dryer is operated at about 800 fpm (feet per minute) (244 meters per minute). The web is then passed between two calender rolls. Both the top and bottom calender (transfer) rolls are sprayed with a chemical softener solution, further described below, using SU14 air atomizing nozzles (Spraying Systems Co.; air cap #73328 and fluid cap #2850).

Components of the chemical softener mixture are:

1. Partially hydrogenated tallow diester chloride quaternary ammonium compound premixed with polyethylene glycol 400. The premix is 74% quaternary ammonium compound (Adogen SDMC-type from Witco incorporated and 26% PEG 400, available from J.T. Baker Company of Phillipsburg, N.J.).
2. Calcium Chloride Pellets from J. T. Baker Company of Phillipsburg, N.J.
3. Sulfuric acid from J. T. Baker Company of Phillipsburg, N.J.

The chemical softener mixture is prepared by dissolving calcium chloride in the required quantity of water. The salt solution is then adjusted to pH of about 4 using sulfuric acid. The resultant mixture is heated to about 75° C. The premix of quaternary compound and PEG 400 is then added as a paste and stirred until the mixture is fully homogeneous. After cooling and addition of make-up water, the components are used in a proportion sufficient to provide a composition having the following approximate concentrations:

25% Partially hydrogenated tallow diester chloride quaternary ammonium compound

16% PEG 400

5% $CaCl_2$

54% Water

The two calender rolls are biased together and operated at surface speeds of 640 fpm (about 195 meters per minute). The chemical softener mixture is transferred from the bottom calender roll to one side of the tissue web by direct pressure. The reel which winds the paper onto the core is operated at 656 fpm (200 meters per minute), which produces a percent crepe of about 18%. The resultant tissue paper has a basis weight of about 20.9 lb per 3000 $ft^2$.

The resultant one-ply tissue web is converted into a layered, single-ply creped pattern densified tissue paper product with an improved tactile sense of softness relative to an untreated control.

Example 3

This example illustrates another method that can be used to make soft tissue paper treated with a softening additive according to the present invention. This example demonstrates the production of a layered tissue paper web with the softening composition of the present invention (prepared by the preferred method as described above) applied to one side wherein the tissue paper webs are combined into a two-ply tissue paper product.

A pilot scale Fourdrinier papermaking machine is used in the practice of the present invention.

An aqueous slurry of NSK of about 3% consistency is made up using a conventional repulper and is passed through a stock pipe toward the headbox of the Fourdrinier.

In order to impart a temporary wet strength to the finished product, a 1% dispersion of Parez 750® is prepared and is added to the NSK stock pipe at a rate sufficient to deliver 0.5% Parez 750® based on the dry weight of the NSK fibers.

The absorption of the temporary wet strength resin is enhanced by passing the treated slurry through an in-line mixer.

An aqueous slurry of Eucalyptus Hardwood Kraft fibers of about 3% consistency is made up using a conventional repulper and is passed through a stock pipe toward the headbox of the Fourdrinier.

In order to impart a temporary wet strength to the finished product and to reduce the dustiness or Tinting of the surface of the tissue paper, a 1% dispersion of Parez 750® is prepared and is added to the eucalyptus stock pipe at a rate sufficient to deliver 0.375% Parez 750® based on the dry weight of the eucalyptus fibers. The absorption of the temporary wet strength resin is enhanced by passing the treated slurry through an in-line mixer.

The NSK fibers are diluted with white water at the inlet of a fan pump to a consistency of about 0.15% based on the total weight of the NSK fiber slurry. The eucalyptus fibers, likewise, are diluted with white water at the inlet of a fan pump to a consistency of about 0.15% based on the total weight of the eucalyptus fiber slurry. The eucalyptus slurry and the NSK slurry are both directed to a layered headbox capable of maintaining the slurries as separate streams until they are deposited onto a forming fabric on the Fourdrinier.

The paper machine has a layered headbox having a top chamber, a center chamber, and a bottom chamber. The eucalyptus fiber slurry is pumped through the top and center headbox chambers and, simultaneously, the NSK fiber slurry is pumped through the bottom headbox chamber and delivered in superposed relation onto the Fourdrinier wire to form thereon a two-layer embryonic web, of which about 80% is made up of the eucalyptus fibers and 20% is made up of the NSK fibers. Dewatering occurs through the Fourdrinier wire and is assisted by a deflector and vacuum boxes. The Fourdrinier wire is of a 5-shed, satin weave configuration having 87 machine-direction and 76 cross-machine-direction direction monofilaments per inch, respectively.

The embryonic wet web is transferred from the Fourdrinier wire, at a fiber consistency of about 15% at the point of transfer, to a patterned drying fabric. The drying fabric is designed to yield a pattern densified tissue with discontinuous low-density deflected areas arranged within a continuous network of high density (knuckle) areas. This drying fabric is formed by casting an impervious resin surface onto a fiber mesh supporting fabric. The supporting fabric is a 45×52 filament, dual layer mesh. The thickness of the resin cast is about 10 mil above the supporting fabric. The knuckle area is about 40% and the open cells remain at a frequency of about 78 per square inch.

Further de-watering is accomplished by vacuum assisted drainage until the web has a fiber consistency of about 28%.

While remaining in contact with the patterned forming fabric, the patterned web is pre-dried by air blow-through predryers to a fiber consistency of about 62% by weight.

The semi-dry web is then transferred to the Yankee dryer and adhered to the surface of the Yankee dryer with a sprayed creping adhesive comprising a 0.125% aqueous solution of polyvinyl alcohol. The creping adhesive is delivered to the Yankee surface at a rate of 0.1% adhesive solids based on the dry weight of the web.

The fiber consistency is increased to about 96% before the web is dry creped from the Yankee with a doctor blade.

The doctor blade has a bevel angle of about 25 degrees and is positioned with respect to the Yankee dryer to provide an impact angle of about 81 degrees. The Yankee dryer is operated at a temperature of about 350° F. (177° C.) and a speed of about 800 fpm (feet per minute) (about 244 meters per minute).

The web is then passed between two calender rolls. The bottom calender (transfer) roll is sprayed with a chemical softener composition, further described below, using SU14 air atomizing nozzles (Air cap #73328 and Fluid cap #2850) of Spraying Systems Co. of Wheaton, Ill. The two combiner rolls are biased together at roll weight and operated at surface speeds of 656 fpm (about 200 meters per minute) which produces a percent crepe of about 18%.

Agents used in the preparation of the chemical softener mixture are:

1. Partially hydrogenated tallow diester chloride quaternary ammonium compound premixed with polyethylene glycol 400. The pre-mix is 66.2% quaternary ammonium compound available from Witco Chemical Company of Dublin, Ohio.
2. Calcium Chloride pellets from EM Science of Gibbstown, N.J.
3. Silicone Emulsion (Dow Coming 2310) from Dow Coming Corp. of Midland, Mich.
4. Hydrochloric acid from J. T. Baker Company of Phillipsburg, N.J.
5. Ethoxylated polyester (HOE S 4060) stabilizer from Clariant Corp., Charlotte, N.C.
6. Fluorescent brightener (Tinopal CBS-X) from Ciba-Geigy Corp., Greensboro, N.C.

The chemical softener mixture is prepared by combining the antifoam, hydrochloric acid and fluorescent brightener in the required quantity of water. This is then heated to about 75° C. The premix of quaternary compound and PEG 400 is then added as a melted liquid and stirred until the mixture is fully homogeneous. The 2.5% calcium chloride solution is then added with mixing to thin the solution. An Ultra-Turrax model T45 S4 homogenizer is then utilized for 4 hours on a 40–45 gallon batch. Once the solution has cooled to room temperature, the polyester is added with mixing. Finally, the 25% calcium chloride solution is added. The components are used in a proportion sufficient to provide a composition having the following approximate concentrations:

24% Partially hydrogenated tallow diester chloride quaternary ammonium compound

12% PEG 400

0.5% $CaCl_2$

63% Water 0.15% Silicon e Emulsion 13 ppm Hydrochloric acid 0.5% Polyester 89 ppm Tinopal CBS-X The chemical softener mixture is transferred from the bottom calender roll to one side of the tissue web by direct pressure. The resulting tissue paper has a basis weight of about 12.8 lb per 3000ft$^2$.

The web is converted into a homogeneous, double-ply creped patterned densified tissue paper product. The resulting tissue paper has an improved tactile sense of softness relative to the untreated control.

Example 4

This example is intended to demonstrate the improved softness of tissue webs treated with the compositions of the present invention.

Panel softness of the treated webs from Examples 1, 2 and 3 were measured using the method described in the TEST METHODS section below. The results of this evaluation (along with other properties of the treated webs) are listed in Table 1.

TABLE 1

| | Example 1 | Example 2 | Example 3 |
|---|---|---|---|
| Basis Weight (lb/3000 $ft^2$) | 25.2 | 20.5 | 24.3 |
| Product | 2 ply bath | 1 ply bath | 2 ply bath |
| Content of Softener (%)[1] | 1.1 | 1.3 | 1.7 |
| Caliper, mil | 13.8 | 15.2 | 19.4 |
| Tensile Strength (g/in) | 455 | 393 | 472 |
| Softness score, PSU | +0.84 | +0.93 | +1.1 |

[1]The content of softener is expressed as a % of partially hydrogenated tallow diester chloride quaternary ammonium compound, by weight, compared to the total weight of the finished tissue product.

As can be seen, all three tissue paper products comprising treated webs are substantially softer than an untreated control (reference for softness evaluation).

TEST METHODS

Softening Active Ingredient Level on Tissue

Analysis of the amounts of softening active ingredients described herein that are retained on tissue paper webs can be performed by any method accepted in the applicable art. These methods are exemplary, and are not meant to exclude other methods which may be useful for determining levels of particular components retained by the tissue paper.

The following method is appropriate for determining the quantity of the preferred quaternary ammonium compounds (QAC) that may deposited by the method of the present invention. A standard anionic surfactant (sodium dodecylsulfate—NaDDS) solution is used to titrate the QAC using a dimidium bromide indicator.

Preparation of Standard Solutions

The following methods are applicable for the preparation of the standard solutions used in this titration method.

Preparation of Dimidium Bromide Indicator

To a 1 liter volumetric flask:

A) Add 500 milliliters of distilled water.

B) Add 40 ml. of dimidium bromide-disulphine blue indicator stock solution, available from Gallard-Schlesinger Industries, Inc. of Carle Place, N.Y.

C) Add 40 ml. of 5N $H_2SO_4$

D) Fill flask to the mark with distilled water and mix.

Preparation of the NaDDS solution to a 1 liter volumetric flask:

A) Weigh 0.1154 grams of NaDDS available from Aldrich Chemical Co. of Milwaukee, Wis. as sodium dodecyl sulfate (ultra pure).

B) Fill flask to mark with distilled water and mix to form a 0.0004N solution.

Method

1. On an analytical balance, weigh approximately 0.5 grams of tissue. Record the sample weight to the nearest 0.1 mg.
2. Place the sample in a glass cylinder having a volume of about 150 milliliters which contains a star magnetic stirrer. Using a graduated cylinder, add 20 milliliters. of methylene chloride.
3. In a fume hood, place the cylinder on a hot plate turned to low heat. Bring the solvent to a full boil while stirring and using a graduated cylinder, add 35 milliliters of dimidium bromide indicator solution.
4. While stirring at high speed, bring the methylene chloride to a full boil again. Turn off the heat, but continue to stir the sample. The QAC will complex with the indicator forming a blue colored compound in the methylene chloride layer.
5. Using a 10 ml. burette, titrate the sample with a solution of the anionic surfactant. This is done by adding an aliquot of titrant and rapidly stirring for 30 seconds. Turn off the stir plate, allow the layers to separate, and check the intensity of the blue color. If the color is dark blue add about 0.3 milliliters of titrant, rapidly stir for 30 seconds and turn off stirrer. Again check the intensity of the blue color. Repeat if necessary with another 0.3 milliliters When the blue color starts to become very faint, add the titrant dropwise between stirrings. The endpoint is the first sign of a slight pink color in the methylene chloride layer.
6. Record the volume of titrant used to the nearest 0.05 ml.
7. Calculate the amount of QAC in the product using the equation:

$$\frac{(\text{milliliters of } NaDDS - X) * Y * 2}{\text{Sample weight in grams}} = \#/\text{ton } QAC$$

Where X is a blank correction obtained by titrating a specimen without the QAC of the present invention. Y is the milligrams of QAC that 1.00 milliliters of NaDDS will titrate. (For example, Y=0.254 for one particularly preferred QAC, i.e. diestherdi(touch-hydrogenated)tallow dimethyl chloride.)

Tissue Density

The density of tissue paper, as that term is used herein, is the average density calculated as the basis weight of that paper divided by the caliper, with the appropriate unit conversions incorporated therein. Caliper of the tissue paper, as used herein, is the thickness of the paper when subjected to a compressive load of 95 g/$in^2$ (15.5 g/$cm^2$).

Panel Softness of Tissue Papers

Ideally, prior to softness testing, the paper samples to be tested should be conditioned according to TAPPI Method #T4020M-88. Preferably, samples are preconditioned for 24 hours at 10 to 35% relative humidity and within a temperature range of 22 to 40° C. After this preconditioning step, samples should be conditioned for 24 hours at a relative humidity of 48 to 52% and within a temperature range of 22 to 24° C.

Ideally, the softness panel testing should take place within the confines of a constant temperature and humidity room. If this is not feasible, all samples, including the controls, should experience identical environmental exposure conditions.

Softness testing is performed as a paired comparison in a form similar to that described in "Manual on Sensory Testing Methods", ASTM Special Technical Publication 434, published by the American Society For Testing and Materials 1968 and is incorporated herein by reference. Softness is evaluated by subjective testing using what is referred to as a Paired Difference Test. The method employs a standard external to the test material itself. For tactile perceived softness two samples are presented such that the subject cannot see the samples, and the subject is required to choose one of them on the basis of tactile softness. The result of the test is reported in what is referred to as Panel Score Unit (PSU). With respect to softness testing to obtain the softness data reported herein in PSU, a number of softness panel tests are performed. In each test ten practiced softness judges are asked to rate the relative softness of three sets of paired samples. The pairs of samples are judged one pair at a time by each judge: one sample of each pair being designated X and the other Y. Briefly, each X sample is graded against its paired Y sample as follows:

1. a grade of plus one is given if X is judged to may be a little softer than Y, and a grade of minus one is given if Y is judged to may be a little softer than X;
2. a grade of plus two is given if X is judged to surely be a little softer than Y, and a grade of minus two is given if Y is judged to surely be a little softer than X;
3. a grade of plus three is given to X if it is judged to be a lot softer than Y, and a grade of minus three is given if Y is judged to be a lot softer than X; and, lastly:
4. a grade of plus four is given to X if it is judged to be a whole lot softer than Y, and a grade of minus 4 is given if Y is judged to be a whole lot softer than X.

The grades are averaged and the resultant value is in units of PSU. The resulting data are considered the results of one panel test. If more than one sample pair is evaluated then all sample pairs are rank ordered according to their grades by paired statistical analysis. Then, the rank is shifted up or down in value as required to give a zero PSU value to which ever sample is chosen to be the zero-base standard. The other samples then have plus or minus values as determined by their relative grades wit h respect to the zero base standard. The number of panel tests performed and averaged is such that about 0.2 PSU re presents a significant difference in subjectively perceived softness.

Strength of Tissue Papers

Dry Tensile Strength

This method is intended for use on finished paper products, reel samples, and unconverted stocks. The tensile strength of such products may be determined on one inch wide strips of sample using a Thwing-Albert Intelect II Standard Tensile Tester (Thwing-Albert Instrument Co of Philadelphia, Pa.).

Sample Conditioning and Preparation

Prior to tensile testing, the paper samples to be tested should be conditioned according to TAPPI Method #T402OM-88. All plastic and paper board packaging materials must be carefully removed from the paper samples prior to testing. The paper samples should be conditioned for at least 2 hours at a relative humidity of 48 to 52% and within a temperature range of 22 to 24° C. Sample preparation and all aspects of the tensile testing should also take place within the confines of t he constant temperature and humidity room.

For finished product, discard any damaged product. Next, remove 5 strips of four usable units (also termed sheets) and stack one on top to the other to form a long stack with the perforations between the sheets coincident. Identify sheets 1 and 3 for machine direction tensile measurements and sheets 2 and 4 for cross direction tensile measurements. Next, cut through the perforation line using a paper cutter (JDC-1-10 or JDC-1-12 with safety shield from Thwing-Albert Instrument Co. of Philadelphia, Pa.) to make 4 separate stocks. Make sure stacks 1 and 3 are still identified for machine direction testing and stacks 2 and 4 are identified for cross direction testing.

Cut two 1" wide strips in the machine direction from stacks 1 and 3. Cut two 1" wide strips in the cross direction from stacks 2 and 4. There are now four 1" wide strips for machine direction tensile testing and four 1" wide strips for cross direction tensile testing. For these finished product samples, all eight 1" wide strips are five usable units (also termed sheets) thick.

For unconverted stock and/or reel samples, cut a 15" by 15" sample which is 8 plies thick from a region of interest of the sample using a paper cutter (JDC-1-10 or JDC-1-12 with safety shield from Thwing-Albert Instrument Co of Philadelphia, Pa.). Make sure one 15" cut runs parallel to the machine direction while the other runs parallel to the cross direction. Make sure the sample is conditioned for at least 2 hours at a relative humidity of 48 to 52% and within a temperature range of 22 to 24° C. Sample preparation and all aspects of the tensile testing should also take place within the confines of the constant temperature and humidity room.

From this preconditioned 15" by 15" sample which is 8 plies thick, cut four strips 1" by 7" with the long 7" dimension running parallel to the machine direction. Note these samples as machine direction reel or unconverted stock samples. Cut an additional four strips 1" by 7" with the long 7" dimension running parallel to the cross direction. Note these samples as cross direction reel or unconverted stock samples. Make sure all previous cuts are made using a paper cutter (JDC-1-10 or JDC-1-12 with safety shield from Thwing-Albert Instrument Co. of Philadelphia, Pa.). There are now a total of eight samples: four 1" by 7" strips which are 8 plies thick with the 7" dimension running parallel to the machine direction and four 1" by 7" strips which are 8 plies thick with the 7"dimension running parallel to the cross direction.

Operation of Tensile Tester

For the actual measurement of the tensile strength, use a Thwing-Albert Intelect II Standard Tensile Tester (Thwing-Albert Instrument Co. of Philadelphia, Pa.). Insert the flat face clamps into the unit and calibrate the tester according to the instructions given in the operation manual of the Thwing-Albert Intelect II. Set the instrument crosshead speed to 4.00 in/min and the 1st and 2nd gauge lengths to 2.00 inches. The break sensitivity should be set to 20.0 grams and the sample width should be set to 1.00" and the sample thickness at 0.025".

A load cell is selected such that the predicted tensile result for the sample to be tested lies between 25% and 75% of the range in use. For example, a 5000 gram load cell may be used for samples with a predicted tensile range of 1250 grams (25% of 5000 grams) and 3750 grams (75% of 5000 grams). The tensile tester can also be set up in the 10% range with the 5000 gram load cell such that samples with predicted tensiles of 125 grams to 375 grams could be tested.

Take one of the tensile strips and place one end of it in one clamp of the tensile tester. Place the other end of the paper strip in the other clamp. Make sure the long dimension of the strip is running parallel to the sides of the tensile tester. Also make sure the strips are not overhanging to the either side of the two clamps. In addition, the pressure of each of the clamps must be in full contact with the paper sample.

After inserting the paper test strip into the two clamps, the instrument tension can be monitored. If it shows a value of 5 grams or more, the sample is too taut. Conversely, if a period of 2–3 seconds passes after starting the test before any value is recorded, the tensile strip is too slack.

Start the tensile tester as described in the tensile tester instrument manual. The test is complete after the crosshead automatically returns to its initial starting position. Read and record the tensile load in units of grams from the instrument scale or the digital panel meter to the nearest unit.

If the reset condition is not performed automatically by the instrument, perform the necessary adjustment to set the instrument clamps to their initial starting positions. Insert the next paper strip into the two clamps as described above and obtain a tensile reading in units of grams. Obtain tensile readings from all the paper test strips. It should be noted that readings should be rejected if the strip slips or breaks in or at the edge of the clamps while performing the test.

Calculations

For the four machine direction 1" wide finished product strips, sum the four individual recorded tensile readings. Divide this sum by the number of strips tested. This number should normally be four. Also divide the sum of recorded tensiles by the number of usable units per tensile strip. This is normally five for both 1-ply and 2-ply products.

Repeat this calculation for the cross direction finished product strips.

For the unconverted stock or reel samples cut in the machine direction, sum the four individual recorded tensile readings. Divide this sum by the number of strips tested. This number should normally be four. Also divide the sum of recorded tensiles by the number of usable units per tensile strip. This is normally eight.

Repeat this calculation for the cross direction unconverted or reel sample paper strips.

All results are in units of grams/inch.

For purposes of this specification, the tensile strength should be converted into a specific total tensile strength" defined as the sum of the tensile strength measured in the machine and cross machine directions, divided by the basis weight, and corrected in units to a value in meters.

| Viscosity | |
|---|---|
| Overview | |
| Viscosity is measured at a shear rate of 100 ($s^{-1}$) using a rotational viscometer. The samples are subjected to a linear stress sweep, which applies a range of stresses, each at a constant amplitude. | |
| Apparatus | |
| Viscometer | Dynamic Stress Rheometer Model SR500 which is available from Rheometrics Scientific, Inc. of Piscataway, NJ |
| Sample Plates | 25 mm parallel insulated plates are used |
| Setup | |
| Gap | 0.5 mm |
| Sample Temperature | 20° C. |
| Sample Volume | at least 0.2455 $cm^3$ |
| Initial Shear Stress | 10 dynes/$cm^2$ |
| Final Shear Stress | 1,000 dynes/$cm^2$ |
| Stress Increment | 25 dynes/$cm^2$ applied every 20 seconds |

Method

Place the sample on the sample plate with the gap open. Close the gap and operate the rheometer according to the manufacturer's instructions to measure viscosity as a function of shear stress between the initial shear stress and the final shear stress using the stress increment defined above.

Results and Calculation

The resulting graphs plot log shear rate ($s^{-1}$) on the x-axis, log viscosity, Poise (P) on the left y-axis, and stress (dynes/$cm^2$) on the right y-axis. Viscosity values are read at a shear rate of 100 ($s^{-1}$). The values for viscosity are converted from P to centipoise (cP) by multiplying by 100.

The disclosures of all patents, patent applications (and any patents which issue thereon, as well as any corresponding published foreign patent applications), and publications mentioned throughout this description are hereby incorporated by reference herein. It is expressly not admitted, however, that any of the documents incorporated by reference herein teach or disclose the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A soft tissue paper product, said soft tissue paper product comprising:

one or more plies of a tissue paper; and a chemical softening composition deposited at least one outer surface of said tissue, said chemical softening composition comprising:

a softening active ingredient, wherein said softening active ingredient comprises a quaternary ammonium compound; and from about 0.1% to about 10% by weight of the softening composition of an electrolyte, wherein said electrolyte comprises a salt selected from the group consisting of the halide, nitrate, nitrite, and sulfate salts of alkali or alkaline earth metals, the halide, nitrate, nitrite, and sulfate salts of ammonia, the alkali and alkaline earth salts of formic and acetic acid, and the ammonium salts of formic and acetic acid.

2. The tissue paper of claim 1 wherein said chemical softening composition is deposited as uniform, discrete surface deposits, spaced apart at a frequency between about 5 areas per lineal inch and about 100 areas per lineal inch.

3. The tissue paper of claim 1 wherein said quaternary ammonium compound has the formula:

$$(R_1)_{4-m}—N^+—[R_2]_mX^-$$

wherein m is 1 to 3;

each $R_1$ is a $C_1$–$C_6$ alkyl or alkenyl group, hydroxyalkyl group, hydrocarbyl or substituted hydrocarbyl group, alkoxylated group, benzyl group, or mixtures thereof;

each $R_2$ is a $C_{14}$–$C_{22}$ alkyl or alkenyl_group, hydroxyalkyl group, hydrocarbyl or substituted hydrocarbyl group, alkoxylated group, benzyl group, or mixtures thereof; and $X^-$ is any softener-compatible anion.

4. The tissue paper of claim 3 wherein m is 2, $R_1$ is methyl and $R_2$ is $C_{16}$–$C_{18}$ alkyl or alkenyl.

5. The tissue paper of claim 4 wherein $X^-$ is chloride or methyl sulfate.

6. The tissue paper of claim 3 wherein said chemical softening composition ingredient further comprises a polyhydroxy compound.

7. The tissue paper of claim 6 wherein said polyhydroxy compound is selected from a group consisting of polyethylene glycol, polypropylene glycol and mixtures thereof.

8. The tissue paper of claim 1 wherein said quaternary ammonium compound has the formula:

$$(R_1)_{4-m}—N^+—[(CH_2)_n—Y—R_3]_mX^-$$

wherein

Y is —O—(O)C—, or —C(O)—O—, or —NH—C(O)—, or —C(O)—NH—;

m is 1 to 3;

n is 0 to 4;

each $R_1$ is a $C_1$–$C_6$ alkyl or alkenyl group, hydroxyalkyl group, hydrocarbyl or substituted hydrocarbyl group, alkoxylated group, benzyl group, or mixtures thereof;

each $R_3$ is a $C_{13}$–$C_{21}$ alkyl or alkenyl group, hydroxyalkyl group, hydrocarbyl or substituted hydrocarbyl group, alkoxylated group, benzyl group, or mixtures thereof; and $X^-$ is any softener-compatible anion.

9. The tissue paper of claim 8 wherein m is 2, n is 2, $R_1$ is methyl, $R_3$ is $C_{15}$–$C_{17}$ alkyl or alkenyl, and Y is —O—(O)C—, or —C(O)—O—.

10. The tissue paper of claim 9 wherein $X^-$ is chloride or methyl sulfate.

11. The tissue paper of claim 8 wherein said chemical softening composition further comprises a polyhydroxy compound.

12. The tissue paper of claim 11 wherein said polyhydroxy compound is selected from a group consisting of polyethylene glycol, polypropylene glycol and mixtures thereof.

13. The tissue paper of claim 12 wherein said polyhydroxy compound comprises polyethylene glycol.

14. The tissue paper of claim 1 wherein said electrolyte comprises a salt selected from the group consisting of the chloride salts of sodium, calcium, and magnesium.

15. The tissue paper of claim 14 wherein said electrolyte comprises calcium chloride.

* * * * *